US009049972B1

(12) United States Patent
Krebs

(10) Patent No.: US 9,049,972 B1
(45) Date of Patent: Jun. 9, 2015

(54) VACUUM CLEANER

(71) Applicant: BISSELL Homecare, Inc., Grand Rapids, MI (US)

(72) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 14/150,325

(22) Filed: Jan. 8, 2014

Related U.S. Application Data

(60) Provisional application No. 61/750,611, filed on Jan. 9, 2013.

(51) Int. Cl.
*A47L 9/16* (2006.01)
*A47L 5/28* (2006.01)

(52) U.S. Cl.
CPC .... *A47L 5/28* (2013.01); *A47L 9/16* (2013.01)

(58) Field of Classification Search
USPC ..... 15/350, 353, 352, 347; 55/337, 410, 55/414, 429, 447, 459.1, 343, 345, 413, 55/424, 426, 452, 457
See application file for complete search history.

(56) References Cited

U.S. PATENT DOCUMENTS

| | | | | |
|---|---|---|---|---|
| 964,428 | A | 7/1910 | Johnson et al. | |
| 2,071,975 | A | 1/1936 | Holm-Hansen et al. | |
| 3,969,096 | A | 7/1976 | Richard | |
| 5,853,440 | A | 12/1998 | Dyson | |
| 5,893,936 | A | 4/1999 | Dyson | |
| 6,599,339 | B2 | 7/2003 | Oh | |
| 6,613,116 | B2 * | 9/2003 | Oh | 55/413 |
| 6,702,868 | B2 | 3/2004 | Oh et al. | |
| 7,544,226 | B2 | 6/2009 | Oh | |
| 7,556,662 | B2 * | 7/2009 | Lee et al. | 55/345 |
| 7,559,965 | B2 | 7/2009 | Oh et al. | |
| 7,691,161 | B2 | 4/2010 | Oh et al. | |
| 7,731,771 | B2 | 6/2010 | Lee et al. | |
| 7,763,090 | B2 | 7/2010 | Gomiciaga-Pereda et al. | |
| 2002/0178697 | A1 * | 12/2002 | Oh et al. | 55/337 |
| 2002/0178699 | A1 * | 12/2002 | Oh | 55/337 |
| 2005/0252179 | A1 * | 11/2005 | Oh et al. | 55/337 |
| 2006/0168922 | A1 * | 8/2006 | Oh | 55/337 |
| 2009/0229071 | A1 * | 9/2009 | Fester et al. | 15/347 |
| 2012/0167336 | A1 | 7/2012 | Tran et al. | |

FOREIGN PATENT DOCUMENTS

| | | | |
|---|---|---|---|
| EP | 0972573 | A1 | 1/2000 |
| WO | 2010085050 | A2 | 7/2010 |

* cited by examiner

*Primary Examiner* — Dung Van Nguyen

(74) *Attorney, Agent, or Firm* — McGarry Bair PC

(57) ABSTRACT

A vacuum cleaner has a separation/collection module for separating dirt and other contaminants from a dirt-containing working airstream and collecting the separated dirt. The module can include at least one cyclonic separation stage and an exhaust grill fluidly positioned between the separation stage and an air outlet from the collection module.

19 Claims, 8 Drawing Sheets

VACUUM CLEANER

CROSS-REFERENCE TO RELATED APPLICATION(S)

This application claims the benefit of U.S. Provisional Patent Application No. 61/750,611, filed Jan. 9, 2013, which is incorporated herein by reference in its entirety.

BACKGROUND

Upright vacuum cleaners employ a variety of dirt separators to remove dirt and debris from a working air stream. Some dirt separators use one or more frusto-conical-shaped separator(s) and others use high-speed rotational motion of the air/dirt to separate the dirt by centrifugal force. Typically, working air enters and exits at an upper portion of the dirt separator as the bottom portion of the dirt separator is used to collect debris. Before exiting the dirt separator, the working air may flow through an exhaust grill. The exhaust grill can have perforations, holes, vanes, or louvers defining openings through which air may pass.

BRIEF SUMMARY

According to one embodiment of the invention, a vacuum cleaner including a housing comprising a suction nozzle, a suction source fluidly connected to the suction nozzle for creating a working airstream through the housing, a cyclone separator for separating contaminants from the working airstream, the cyclone separator comprising an air inlet in fluid communication with the suction nozzle, at least one separation chamber, and an air outlet, and an exhaust grill mounted within the at least one separation chamber and fluidly upstream from the air outlet such that the working air stream passes through the exhaust grill before reaching the air outlet. The exhaust grill includes a substantially cylindrical body having an upper edge and a lower edge and a plurality of sawtooth projections comprising an outer edge having an upper portion and a lower portion, wherein the upper portion of each outer edge is radially offset from the lower portion of each outer edge.

DETAILED DESCRIPTION

The invention relates to vacuum cleaners and in particular to vacuum cleaners having dirt separation and collection assemblies. In one of its aspects, the invention relates to a dirt separation and collection assembly having an exhaust grill positioned between the dirt separator and the air outlet from the assembly. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
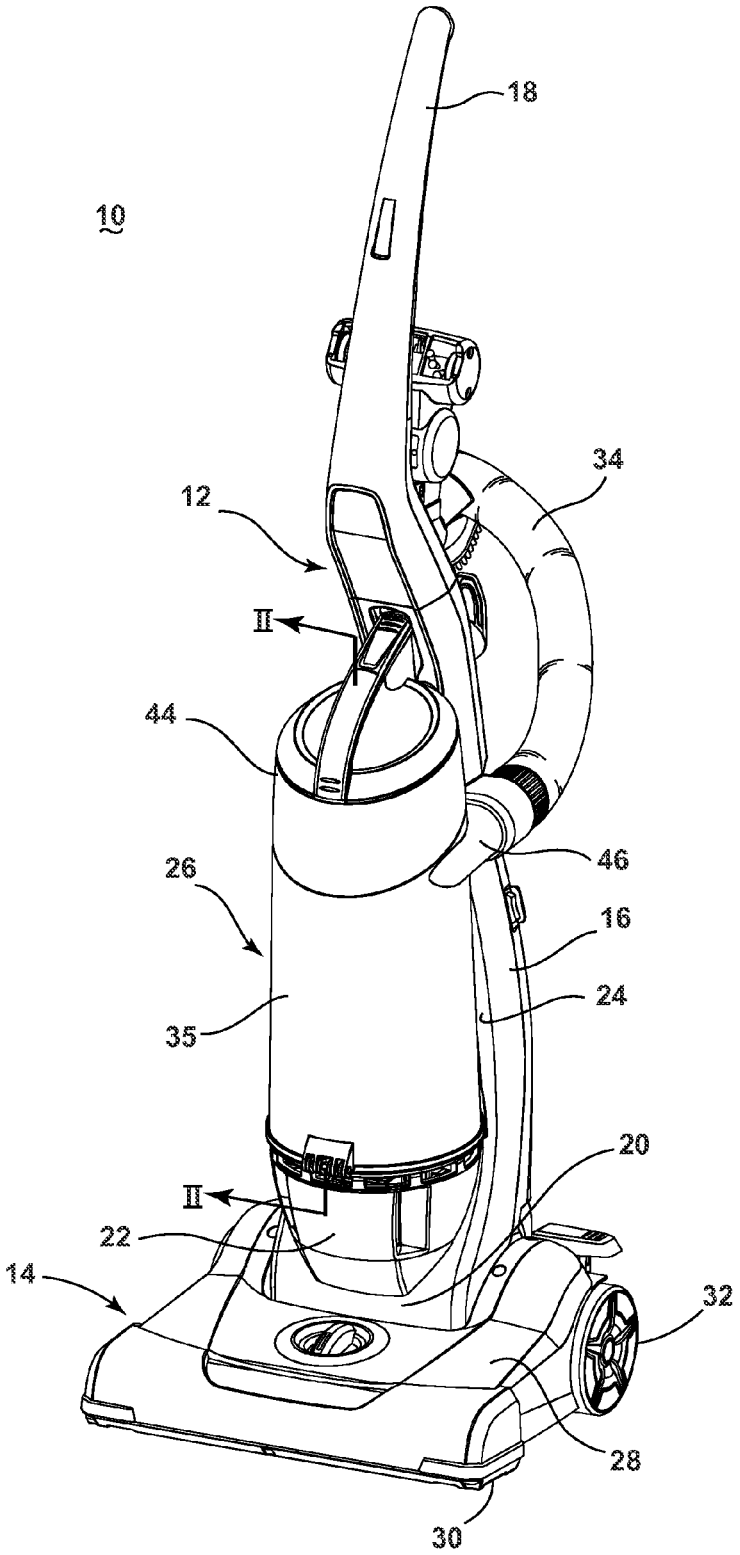
FIG. 1 is a perspective view of a vacuum cleaner according to a first embodiment of the invention.

Referring to the drawings, and in particular to FIG. 1, an upright vacuum cleaner 10 according to a first embodiment of the invention comprises an upright handle assembly 12 pivotally mounted to a foot assembly 14. The handle assembly 12 further comprises a primary support section 16 with a grip 18 on one end to facilitate movement by a user. A motor cavity 20 is formed at an opposite end of the handle assembly 12 to contain a conventional suction source 240 (FIG. 2) such as a vacuum fan/motor assembly oriented transversely therein for creating a working airstream through the vacuum cleaner 10. The handle assembly 12 pivots relative to the foot assembly 14 through a pivot axis that is coaxial with a motor shaft (not shown) associated with the vacuum fan/motor assembly. A post-motor filter housing 22 is formed above the motor cavity 20 and is in fluid communication with the vacuum fan/motor assembly, and receives a filter media (not shown) for filtering air exhausted from the vacuum fan/motor assembly before the air exits the vacuum cleaner 10. A mounting section 24 on the primary support section 16 of the handle assembly 12 receives a separation/collection module 26 for separating dirt and other contaminants from a dirt-containing working airstream.

The foot assembly 14 comprises a housing 28 with a suction nozzle 30 formed at a lower surface thereof and that is in fluid communication with the vacuum fan/motor assembly. While not shown, an agitator can be positioned within the housing 28 adjacent the suction nozzle 30 and operably connected to a dedicated agitator motor, or to the vacuum fan/motor assembly within the motor cavity 20 via a stretch belt. Rear wheels 32 are secured to a rearward portion of the foot assembly 14 and front wheels (not shown) are secured to a forward portion of the foot assembly 14 for moving the foot assembly 14 over a surface to be cleaned. When the separation/collection module 26 is received in the mounting section 24, as shown in FIG. 1, the separation/collection module 26 is in fluid communication with, and fluidly positioned between, the suction nozzle 30 and the vacuum fan/motor assembly within the motor cavity 20. At least a portion of the working air pathway between the suction nozzle 30 and the separation/collection module 26 can be formed by a vacuum hose 34 that can be selectively disconnected from fluid communication with the suction nozzle 30 for above-the-floor cleaning.

Figure 2:
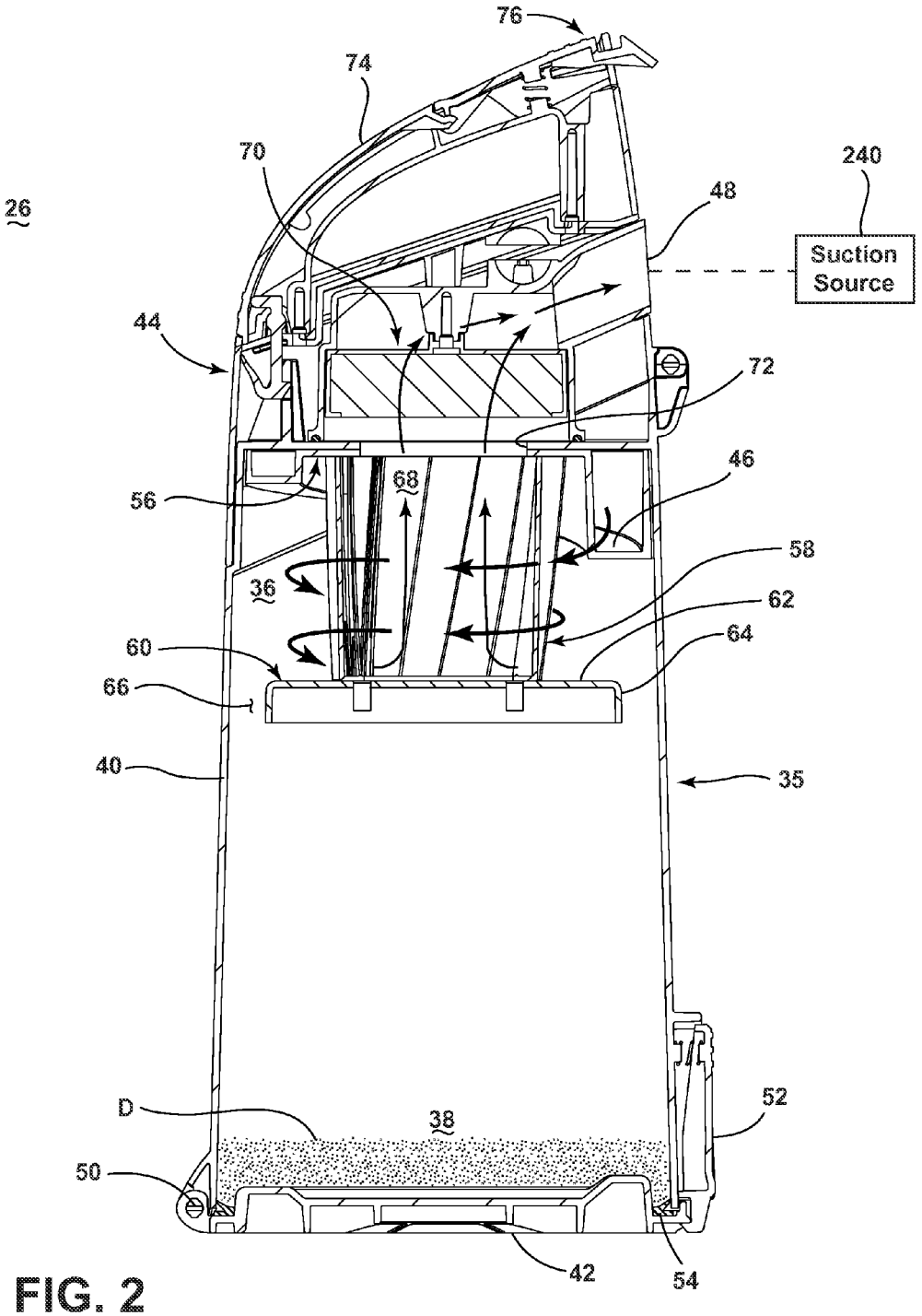
FIG. 2 is a cross-sectional view through a separation/collection module of the vacuum cleaner, taken through line II-II of FIG. 1.

Referring to FIG. 2, the separation/collection module 26 of the first embodiment comprises a housing 35 at least partially defining a single-stage separation or cyclone chamber 36 for separating contaminants from a dirt-containing working airstream and an integrally-formed dirt collection chamber 38 which receives contaminants separated by the cyclone chamber 36.

The module housing 35 is common to the cyclone chamber 36 and the collection chamber 38, and includes a side wall 40, a bottom wall 42, and a cover 44. The side wall 40 is illustrated herein as being generally cylindrical in shape, with a diameter that increases in a direction toward the bottom wall 42. The bottom wall 42 comprises a dirt door that can be selectively opened, such as to empty the contents of the collection chamber 38.

An inlet to the separation/collection module 26 can be at least partially defined by an inlet conduit 46. An outlet from the separation/collection module 26 can be at least partially defined by an outlet conduit 48 extending from the cover 44. The inlet conduit 46 is in fluid communication with the suction nozzle 30 (FIG. 1) and the outlet conduit 48 is in fluid communication with a suction source 240, such as a vacuum fan/motor assembly, within the motor cavity 20 (FIG. 1).

While the cyclone chamber 36 and collection chamber 38 are shown herein as being integrally formed, it is also contemplated that the separation/collection module 26 can be provided with a separate dirt cup having a closed or fixed bottom wall and that is removable from the cyclone chamber 36 to empty dirt collected therein. Furthermore, while a single-stage cyclone is illustrated herein, it is also contemplated that the separation/collection module 26 can be configured with multiple separation stages. As illustrated herein, the separation and collection module is shown as a cyclone separator 26. However, it is understood that other types of separation modules can be used, such as centrifugal separators or bulk separators.

The dirt door 42 is pivotally mounted to the side wall 40 by a hinge 50. A door latch 52 is provided on the side wall 40, opposite the hinge 50, and can be actuated by a user to selectively release the dirt door 42 from engagement with the bottom edge of the side wall 40. The door latch 52 is illustrated herein as comprising a latch that is pivotally mounted to the side wall 40 and spring-biased toward the closed position shown in FIG. 2. By pressing the upper end of the door latch 52 toward the side wall 40, the lower end of the door latch 52 pivots away from the side wall 40 and releases the dirt door 42, under the force of gravity, allowing accumulated dirt to be emptied from the collection chamber 38 through the open bottom of the module housing 35. A gasket 54 can be provided between the dirt door 42 and the bottom edge of the side wall 40 to seal the interface therebetween when the dirt door 42 is closed.

The separation/collection module 26 further includes an exhaust grill 58 for guiding working air from the cyclone chamber 36 out of the separation/collection module 26. The exhaust grill 58 is positioned in the center of the cyclone chamber 36 and can depend from a top wall 56 of the chamber 36. A separator plate 60 can be provided below the exhaust grill 58 to separate the cyclone chamber 36 from the collection chamber 38, and can include a disk-like surface 62 extending radially outwardly from the grill 58 and a downwardly depending peripheral lip 64. A debris outlet 66 from the cyclone chamber 36 can be defined between the separator plate 60 and the side wall 40.

The exhaust grill 58 separates the cyclone chamber 36 from a passageway 68 leading to an optional pre-motor filter assembly 70 within the cover 44 that is upstream of the outlet conduit 48, such that air exiting the cyclone chamber 36 must pass through the filter assembly 70 prior to passing out of the module 26. In alternate embodiments where the separation/collection module 26 is configured with multiple separation stages, the exhaust grill 58 can separate a first, downstream cyclone chamber from a second, upstream cyclone chamber.

The top wall 56 includes a central opening 72 allowing air to pass out of the exhaust grill 58. A handle grip 74 attached to the cover 44 can be gripped by a user to facilitate lifting and carrying the entire vacuum cleaner 10 or just the separation/collection module 26 when removed from the vacuum cleaner 10. The handle grip 74 can be provided with a latch 76 for selectively detaching the separator/collection module 26 from the upright assembly 12 (FIG. 1).

Figure 3:
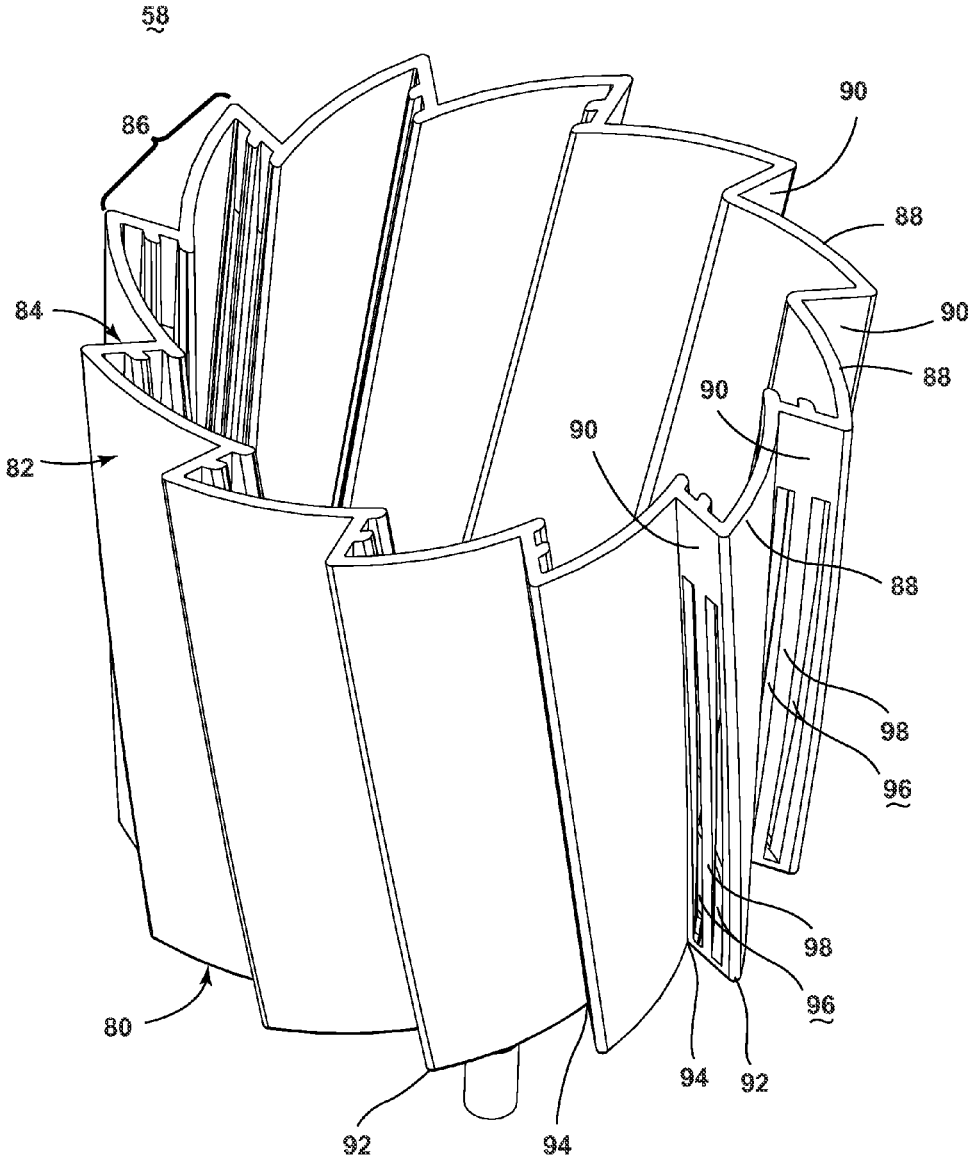
FIG. 3 is a perspective view of an exhaust grill of the separation/collection module shown in FIG. 2.
Figure 4:
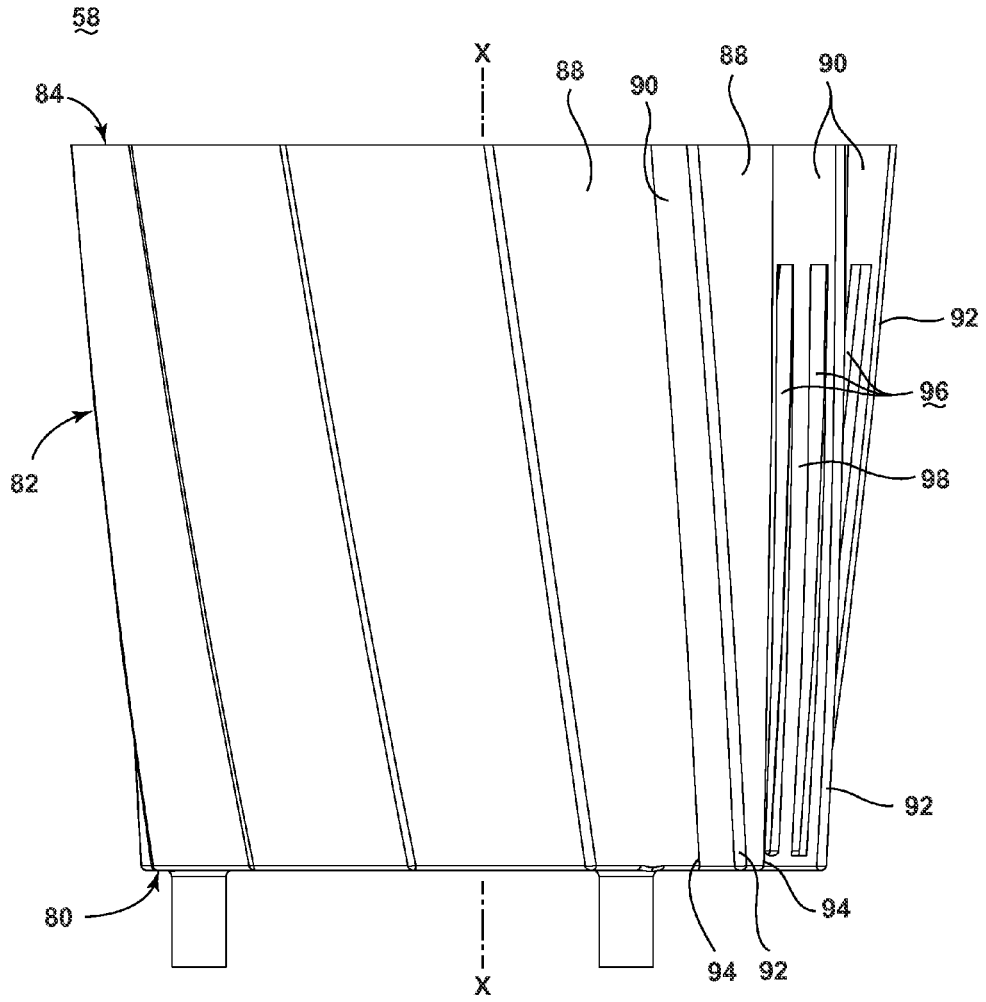
FIG. 4 is a side view of the exhaust grill shown in FIG. 3.
Figure 5:
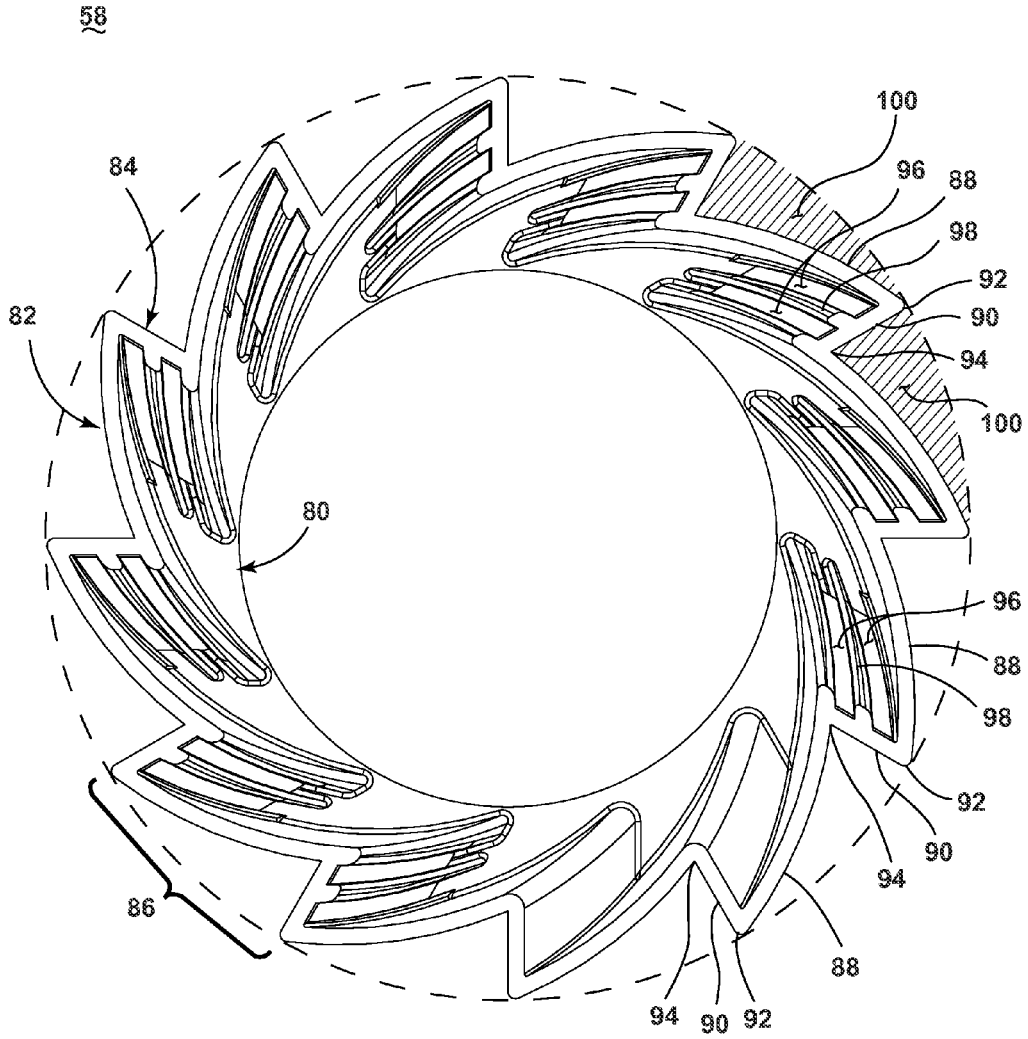
FIG. 5 is a top view of the exhaust grill shown in FIG. 3.

Referring to FIGS. 3-5, the exhaust grill 58 includes a generally cylindrical body having an open bottom wall 80 defining a lower edge of the body and a side wall 82 which extends upwardly from the bottom wall 80 to an open upper edge 84. The side wall is provided with multiple airflow deflectors which act to direct debris away from the exhaust grill 58 and also to slow down the airflow passing through the exhaust grill 58. As illustrated, the side wall 82 has a sawtooth-shaped cross-section when viewed from above, and includes airflow deflectors in the form of a plurality of sawtooth projections 86 extending longitudinally between the bottom wall 80 and the upper edge 84. The overall shape of the grill 58 may be tapered, such that the width of the grill 58 is wider at the upper edge 84 than at the bottom wall 80. As illustrated, the diameter of the grill 58 at the upper edge 84 is greater than the diameter of the grill 58 at the bottom wall 80.

As illustrated, the sawtooth projections 86 are substantially vertically-oriented and include a circumferentially-extending surface 88 connected to a radially-extending surface 90 at an outer edge 92, with the radially-extending surface 90 of one sawtooth projection 86 connected to the circumferentially-extending surface 88 of an adjacent sawtooth projection 86 at an inner edge 94. The radially-extending surfaces 90 can extend at an angle to a central axis X of the grill 58 so that the lower edge defined by the bottom wall 80 appears twisted relative to the upper edge 84. The outer and inner edges 92, 94 can further be substantially parallel to each other, such that the outer face of the radially-extending surface 90 is substantially flat.

At least some of the radially-extending surfaces 90 are partially open in order to provide fluid communication between the cyclone chamber 36 and the passageway 68 (FIG. 2). As shown herein, a majority of the radially-extending surfaces 90 can include adjacent inlet slots 96 that extend substantially the entire length of the inlet surface 90. In one embodiment, two inlet slots 96 are employed. The inlet slots 96 can be separated by a dividing wall 98 which extends from an inner surface of the radially-extending surface 90.

At least one of the radially-extending surfaces 90 can be closed, i.e. solid, and is not provided with any inlet slots. The closed radially-extending surfaces 90 can be oriented in opposing relationship to the inlet conduit 46 (FIG. 2) in order to prevent any incoming debris from immediately entering the grill 58 without first passing around an inner portion of the side wall 40 of the separator module 35.

The circumferentially-extending surfaces 88 are closed, i.e. solid, and interact with the working air flow to rebound debris away from the inlet slots 96. The surfaces 88 are outwardly spaced in a radial direction from the inlet slots 96, which allows debris to deflect off the surfaces 88 before reaching the inlet slots 96.

A void 100 is defined between the outer edges 92 of adjacent sawtooth projections 86. The outer edges 92 project to define an effective circumference of the generally cylindrical body of the exhaust grill 58, as indicated by the dashed line in FIG. 5, such that a plurality of voids 100 are defined between adjacent sawtooth projections 86 and the effective circumference. The effective circumference may define a maximum effective circumference of the exhaust grill 58, with the inner edges 94 defining a minimum effective circumference. As illustrated, each void 100 is bounded by one of the inner edges 94 the outer edges 92 of the adjacent projections 86, and the maximum effective circumference.

The voids 100 define zones of reduced flow velocity at the inlet slots 96, which increases debris separation. The working air flow and entrained debris that swirl around the cyclone chamber 36 (FIG. 2) during operation has both a rotational velocity and a radial velocity. In one example, the rotational velocity can be characterized by the number of rotations debris makes around the cyclone chamber 36 per unit of time and the radial velocity can be characterized by the speed of debris moving along a radial axis originating from the center of the exhaust grill 58.

The sawtooth projections 86 can reduce the distance between the outer perimeter of the exhaust grill 58, defined by the outer edges 92, and the side wall 40 of the separator module 35, which increases the rotational velocity of the working air flow due to the Bernoulli Effect. Debris moving at a higher rotational velocity tends to pass over or past the void 100, rather than being drawn into the void 100 and through the inlet slots 96, because the debris has relatively high inertia and is thus more resistant to changing its trajectory compared to slower moving debris found around exhaust grills without the sawtooth projections 86.

Similarly, the circumferentially-extending surfaces 88 and sawtooth projections 86 tend to deflect working air flow and entrained debris outwardly, which increases the outward radial velocity of the working air flow and entrained debris. The increased outward radial velocity increases inertia of the entrained debris, which can overcome the inward radial velocity of the working air passing through the inlet slots 96. Thus, the debris is more resistant to being drawn inwardly into the void 100 and through the inlet slots 96, which improves debris separation performance since more debris is retained in the separator module 35. Accordingly, the void 100 defines a zone of reduced rotational and radial flow velocity at the inlet slots 96, which reduces the possibility of debris being drawn through the inlet slots 96, thereby improving debris separation performance.

Referring to FIG. 2, in which the flow path of working air is indicated by arrows, the operation of the separation/collection module 26 will be described. The suction source 240, when energized, draws dirt and dirt-containing air from the suction nozzle 30 (FIG. 1) to the inlet conduit 46 and into the separation/collection module 26 where the dirty air swirls around the cyclone chamber 36. It is noted that while the working air within the cyclone chamber 36 flows along an airflow path having both horizontal and vertical components with respect to a central axis of the module 26, the magnitude of the horizontal component is greater than the magnitude of the vertical component. Debris D falls into the collection chamber 38. The working air, which may still contain some smaller or finer debris, then passes through the exhaust grill 58, which can separate out some additional debris by provision of the airflow deflectors, which act to direct debris away from the exhaust grill 58 and also to slow down the airflow passing though the exhaust grill 58. The working air, which may still contain some even smaller or finer debris, proceeds upwardly within the passageway 68 and enters the pre-motor filer assembly 70, where additional debris may be captured. The working air then exits the separation/collection module 26 via the outlet conduit 48, and passes through the suction source 240 before being exhausted from the vacuum cleaner 10. One or more additional filter assemblies (not shown) may be positioned upstream or downstream of the suction source 240. To dispose of collected dirt and dust, the separation/collection module 26 is detached from the vacuum cleaner 10 to provide a clear, unobstructed path for the debris captured in the collection chamber 38 to be removed.

Figure 6:
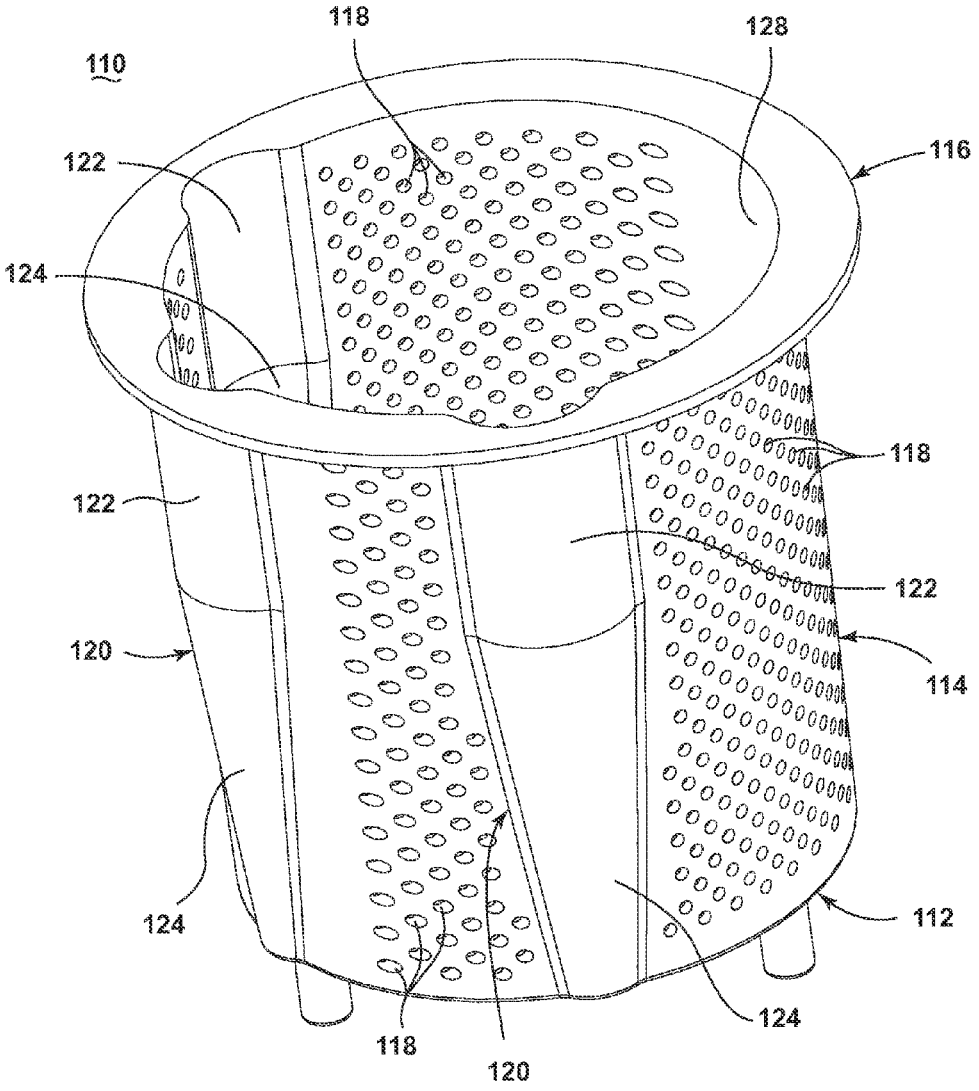
FIG. 6 is a perspective view of an exhaust grill according to a second embodiment of the invention.
Figure 7:
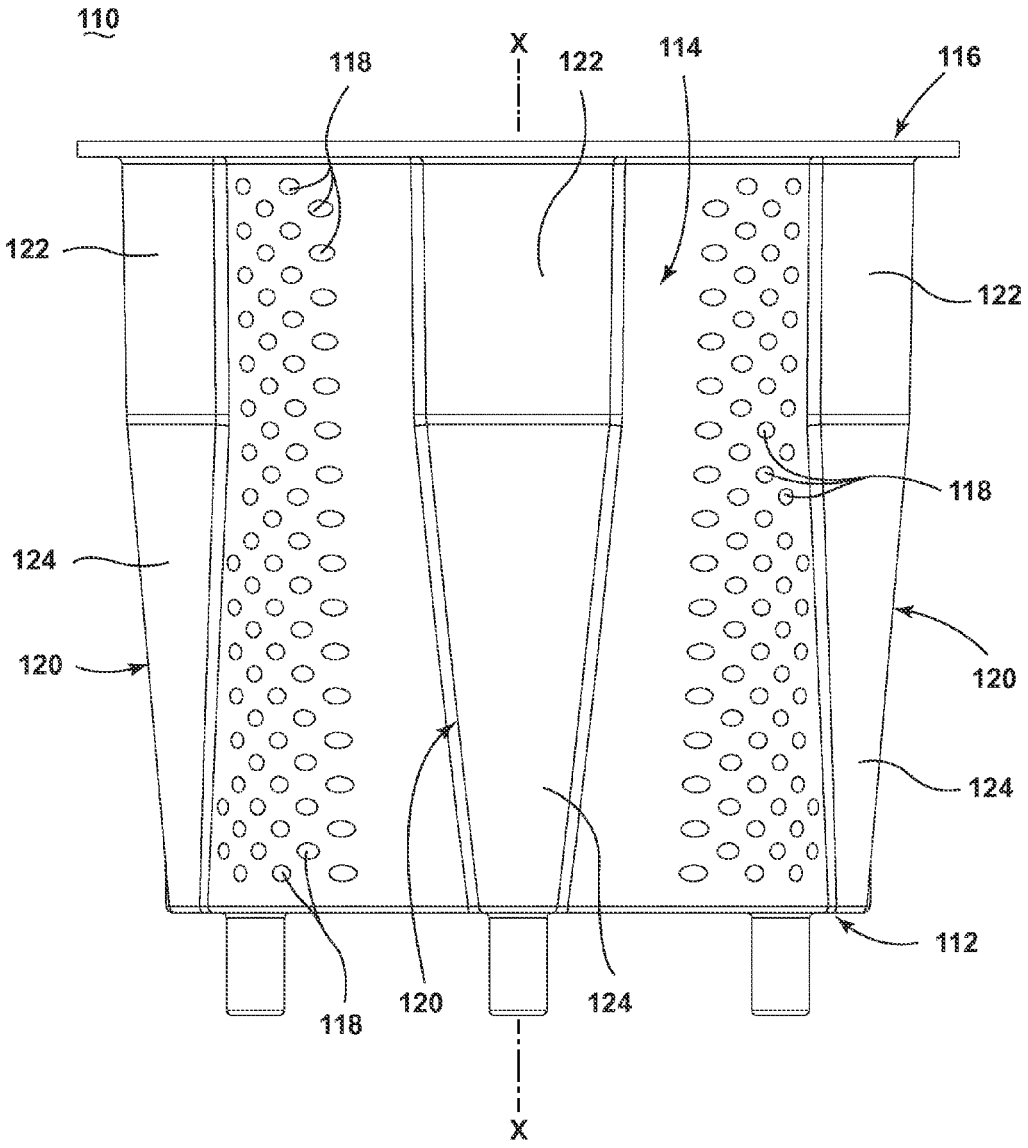
FIG. 7 is a side view of the exhaust grill shown in FIG. 6.
Figure 8:
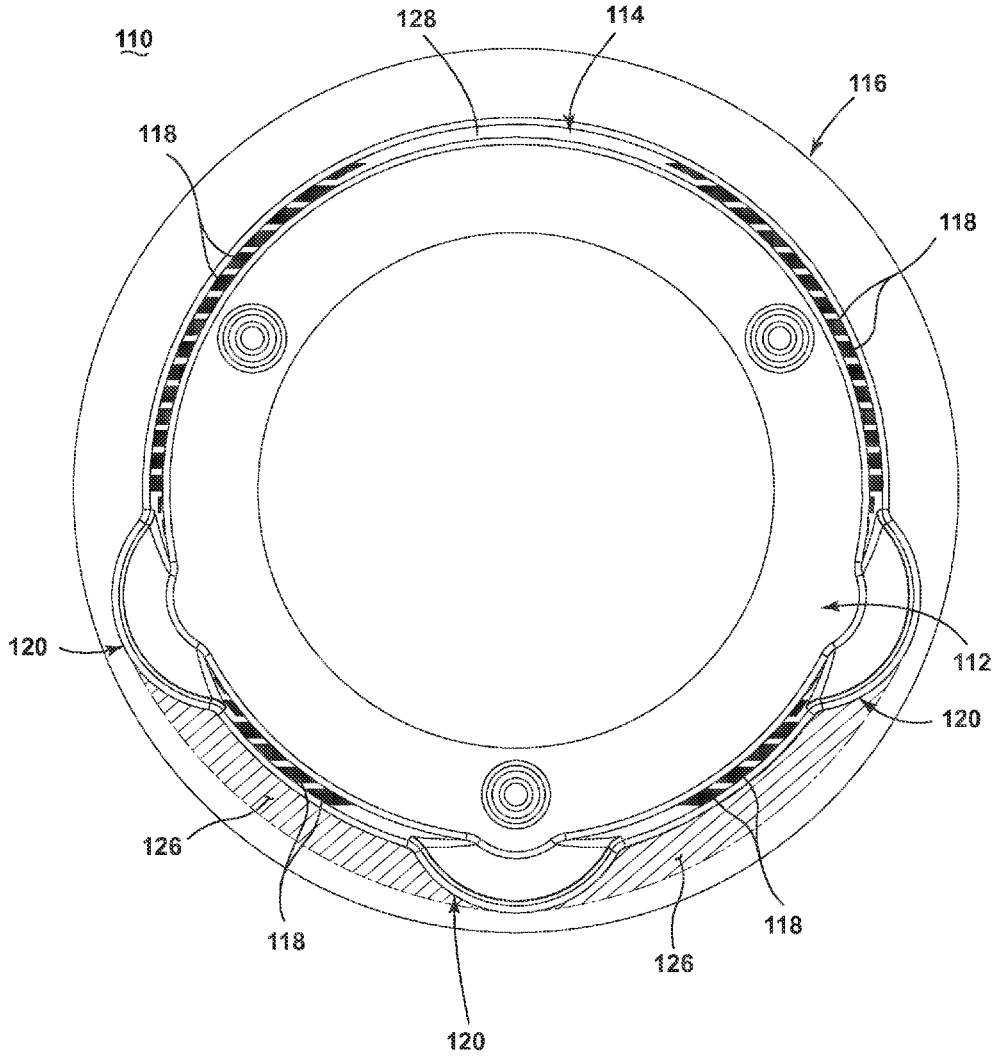
FIG. 8 is a bottom view of the exhaust grill shown in FIG. 6.

FIG. 6-8 illustrate an exhaust grill 110 according to a second embodiment of the invention. The exhaust grill 110 can be used in place of the exhaust grill 58 on the vacuum cleaner 10 shown in FIG. 1-2. The exhaust grill 110 includes a generally cylindrical body having an open bottom wall 112 and a side wall 114 which extends upwardly from the bottom wall 112 to an open upper wall 116. The overall shape of the grill 110 may be tapered, such that the width of the grill 110 is wider at the upper wall 116 than at the bottom wall 112. As illustrated, the diameter of the grill 110 at the upper wall 116 is greater than the diameter of the grill 110 at the bottom wall 112.

The side wall 114 has a plurality of inlet openings 118 to provide fluid communication between the cyclone chamber 36 and the passageway 68 (FIG. 2). The inlet openings 118 can be provided as a series of holes extending through the side wall 114.

The side wall 114 is provided with multiple airflow deflectors which act to direct debris away from the exhaust grill 110 and also to slow down the airflow passing though the exhaust grill 110. As illustrated, the airflow deflectors include a plurality of rounded or convex projections 120 extending longitudinally between the bottom wall 112 and the upper wall 116. The convex projections 120 are substantially vertically-oriented and can extend substantially parallel to a central axis X of the grill 110. The convex projections 120 can be longitudinally shaped to have an upper cylindrical portion 122 and a lower truncated cone portion 124. When viewed from below, as in FIG. 8, both portions 122, 124 have a rounded cross-sectional shape that extends radially outwardly from the side wall 114. The top wall 116 of the grill 110 can extend outwardly beyond the convex projections 120.

The sections of the side wall 114 in between the convex projections 120 can be provided with inlet openings 118, but the convex projections 120 themselves are closed, i.e. solid, and interact with the working air flow to rebound debris away from the inlet openings 118. The projections 120 are outwardly spaced in a radial direction from the inlet openings 118, which allows debris to deflect off the projections 120 before reaching the inlet openings 118.

A void 126 is defined between the outermost portions of adjacent convex projections 120. The convex projections 120 project to define an effective circumference of the generally cylindrical body of the exhaust grill 110, as indicated by the dashed line in FIG. 8, such that a plurality of voids 126 are defined between adjacent projections 120 and the effective circumference. The effective circumference may define a maximum effective circumference of the exhaust grill 110, with the side wall 114 between the projections 120 defining a minimum effective circumference. As illustrated, each void 126 is bounded by a section of the side wall 114, the outermost portions of the adjacent convex projections 120, and the maximum effective circumference. Similar to the description of the previous embodiment, the void 126 defines a zone of reduced rotational and radial flow velocity at the inlet openings 118, which reduces the possibility of debris being drawn therethrough, thereby improving debris separation performance.

In particular, the convex projections 120 can reduce the distance between the outer perimeter of the exhaust grill 110 and the side wall 40 of the separator module 35 (FIG. 2), which increases the rotational velocity of the working air flow due to the Bernoulli Effect. Debris moving at a higher rotational velocity tends to pass over or past the void 126, rather than being drawn into the void 126 and through the inlet openings 118, because the debris has relatively high inertia and is thus more resistant to changing its trajectory compared to slower moving debris found around exhaust grills without the convex projections 120.

Also, the convex projections 120 tend to deflect working air flow and entrained debris outwardly, which increases the outward radial velocity of the working air flow and entrained debris. The increased outward radial velocity increases inertia of the entrained debris, which can overcome the inward radial velocity of the working air passing through the inlet openings 118. Thus, the debris is more resistant to being drawn inwardly into the void 126 and through the inlet openings 118, which improves debris separation performance since more debris is retained in the separator module 35.

At least one section 128 of the side wall 114 is closed, i.e. solid, and is not provided with any inlet openings 118. The closed section 128 can be oriented in opposing relationship to the inlet conduit 46 (FIG. 2) in order to prevent any incoming debris from immediately entering the grill 110.

The vacuum cleaner disclosed herein provides an improved dirt separation and collection assembly, particularly with regard to the exhaust grill 58, 110. One advantage that may be realized in the practice of some embodiments of the described vacuum cleaner is that the exhaust grill 58, 110 is provided with airflow deflectors, which act to direct debris away from the exhaust grill 58, 110. With some previous exhaust grills, debris can enter the inlets of the exhaust grill, rather than being collected, which can lead to the debris clogging a downstream filter, entering the downstream suction source, and/or being exhausted from the vacuum cleaner 10 back into the environment. The exhaust grill 58, 110 described herein has closed, projecting surfaces 88, 120 which deflect or rebound debris away from the inlets to the exhaust grill 58, 110.

Another advantage that may be realized in the practice of some embodiments of the described vacuum cleaner is that the exhaust grill 58, 110 is provided with void spaces 110*m* 126 between projecting surfaces 88, 120, which acts to lower the velocity of the airflow passing though the exhaust grill 58, 110 and increase debris separation.

While the invention has been specifically described in connection with certain specific embodiments thereof, it is to be understood that this is by way of illustration and not of limitation. For example, while the cyclone module assemblies illustrated herein are shown having two concentric stages of separation, it is understood that the louvered exhaust grill could be applied to a single stage separator, multiple parallel first and/or second stage, or additional downstream separators, or other types of cyclone separators. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a housing comprising a suction nozzle;

a suction source fluidly connected to the suction nozzle for creating a working airstream through the housing;

a cyclone separator for separating contaminants from the working airstream, the cyclone separator comprising an air inlet in fluid communication with the suction nozzle, at least one separation chamber, and an air outlet; and an exhaust grill mounted within the at least one separation chamber and fluidly upstream from the air outlet such that the working air stream passes through the exhaust grill before reaching the air outlet, the exhaust grill comprising:

a substantially cylindrical body having an upper edge and a lower edge; and a plurality of sawtooth projections comprising an outer edge having an upper portion and a lower portion, wherein the upper portion of each outer edge is radially offset from the lower portion of each outer edge.

2. The vacuum cleaner from claim 1, wherein the upper portion of each outer edge is circumferentially offset from the lower portion of each outer edge.

3. The vacuum cleaner from claim 1, wherein the an upper portion of each outer edge terminates at the upper edge and a lower portion of each outer edge terminates at the lower edge.

4. The vacuum cleaner from claim 1, wherein the outer edges of the plurality of sawtooth projections project from the substantially cylindrical body to define an effective circumference of the substantially cylindrical body such that a plurality of voids are defined between adjacent sawtooth projections and the effective circumference.

5. The vacuum cleaner from claim 1, wherein each sawtooth projection comprises a circumferentially-extending surface and a radially-extending surface joined to the circumferentially-extending surface at the outer edge.

6. The vacuum cleaner from claim 5, wherein the exhaust grill is positioned at the center of the at least one separation chamber along a central axis, and each radially-extending surface lies at an angle to the central axis.

7. The vacuum cleaner from claim 5, wherein at least some of the plurality of sawtooth projections comprise at least one opening in their radially-extending surface, wherein the at least one opening is in fluid communication with the air outlet.

8. The vacuum cleaner from claim 7, wherein at least one opening comprises an elongated slot that extends substantially the length of the radially-extending surface.

9. The vacuum cleaner from claim 7, wherein at least one of the plurality of sawtooth projections is in opposing relationship to the air inlet and is closed to the working airstream on its radially-extending surface.

10. The vacuum cleaner from claim 7, wherein each circumferentially-extending surface is closed to the working airstream.

11. The vacuum cleaner from claim 5, wherein the plurality of sawtooth projections further comprise an inner edge, wherein the radially-extending surface of one of the plurality of sawtooth projections is connected to the circumferentially-extending surface of an adjacent one of the plurality of sawtooth projections at the inner edge.

12. The vacuum cleaner from claim 11, wherein the inner edge of one of the plurality of sawtooth projections is substantially parallel to the outer edge the one of the plurality of sawtooth projections.

13. The vacuum cleaner from claim 1, wherein the substantially cylindrical body comprises a bottom wall defining the lower edge and a side wall which extends upwardly from the bottom wall to the upper edge, wherein the plurality of sawtooth projections at least partially define the side wall.

14. The vacuum cleaner from claim 1, wherein the substantially cylindrical body is wider at the upper edge than at the lower edge.

15. The vacuum cleaner from claim 1, wherein the plurality of sawtooth projections are substantially vertically-oriented, with the outer edge extending longitudinally between the lower edge and the upper edge.

16. The vacuum cleaner from claim 1, wherein the at least one separation chamber comprises a single separation chamber.

17. The vacuum cleaner from claim 1 and further comprising a dirt collection chamber which receives contaminants separated by the at least one separation chamber.

18. The vacuum cleaner from claim 17 and further comprising a separator plate at the lower edge of the exhaust grill to separate the at least one separation chamber from the dirt collection chamber.

19. The vacuum cleaner from claim 1, wherein the air outlet is in fluid communication with and upstream of the suction source.

* * * * *